United States Patent [19]

Schultz et al.

[11] 4,386,702

[45] Jun. 7, 1983

[54] MOLDED FOAM PLASTIC PLATE PACKING BOX

[76] Inventors: Frank L. Schultz; Marilyn Schultz, both of 600 Sunset Dr., McAllen, Tex. 78501

[21] Appl. No.: 314,511

[22] Filed: Oct. 23, 1981

[51] Int. Cl.[3] ..... B65D 85/30; B65D 81/16

[52] U.S. Cl. ..... 206/523; 206/591; 217/26.5; 220/902

[58] Field of Search ..... 206/523, 303, 586, 454, 206/45, 33, 591; 217/26.5; 220/902

[56] References Cited

U.S. PATENT DOCUMENTS

| | | | |
|---|---|---|---|
| 3,080,964 | 3/1963 | Robinson et al. | 206/303 |
| 3,451,536 | 6/1969 | O'Leary et al. | 206/45.33 |
| 4,113,096 | 9/1978 | Scott | 206/523 |
| 4,114,759 | 9/1978 | Maloney, Jr. | 206/523 |

*Primary Examiner*—William T. Dixson, Jr.
*Attorney, Agent, or Firm*—Littlepage & Webner

[57] ABSTRACT

A molded foam plastic plate packing box for china plates of different sizes has a bottom and lid each with opposite cooperating circular ridges between which a plate is confined.

7 Claims, 6 Drawing Figures

MOLDED FOAM PLASTIC PLATE PACKING BOX

FIELD OF INVENTION

Special receptacles or packages, for plate or sheet, fragile or sensative in Class 206, subclass 454.

PRIOR ART

U.S. Pat. Nos. Weidel 1,908,940; Scott 4,113,096; and Peckar 4,119,204.

OBJECTS

In the boxing of china plates of the dinner plate type great care must be taken to protect them against shock or crushing. Not only must the box itself stand rough handling, but it also must not impose local stresses on the plate within. To avoid local stressing, one object of the invention is to provide a plate packing box having a plurality of opposed ridges and cylindrical surfaces which engage different portions of a conventional dinner-type plate, and which constrain the plate against movement within the box.

A more particular object is to provide, on the hollow box bottom and top, opposed ridges whose free ends provide a nip between which the flange of a dinner-type plate engages, the free ends of which ridges have bevels which engage flatwise against the surfaces of the plate flange. Since the box is molded of resilient foam plastic, and since the ribs are of relatively thin cross section, an extra springy-yieldability is provided along the lines between which the plate flange is nipped.

A further object is to provide a foam plastic plate packing box which will accommodate plates of different diameters. Plate packing boxes have been disclosed in prior patents such as Weidel U.S. Pat. No. 1,908,940; Scott U.S. Pat. No. 4,113,096; and Peckar U.S. Pat. No. 4,119,204 (supra) wherein plates are engaged within packages of molded porous or foam material. However, the boxes disclosed in the prior art do not provided the same type of protection for a plate of one diameter as they do for a plate of another diameter. An object of this invention is to provide a box which will accommodate both relatively large and small diameter plates such that when the box is opened by separation of the top from the bottom, either size plate is displayed on one side in its entirety, and the plate may be removed from the package without need for disconnecting innerlocking tabs or tongues or spacers.

These and other objects will be apparent in the following specification and drawings, in which.

Figure 1:
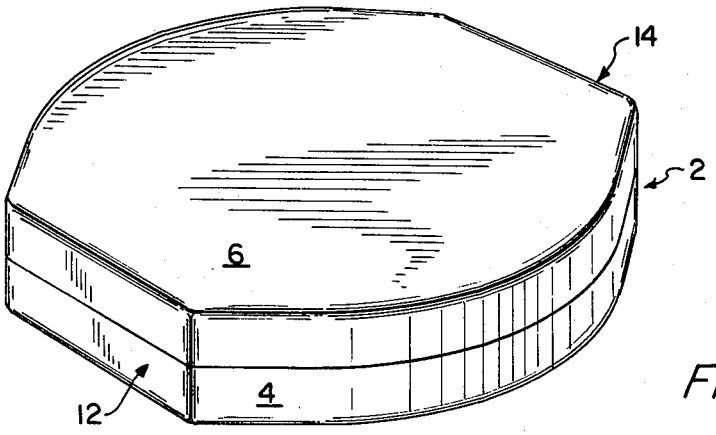
FIG. 1 is a perspective view of the subject package in closed condition.
Figure 2:
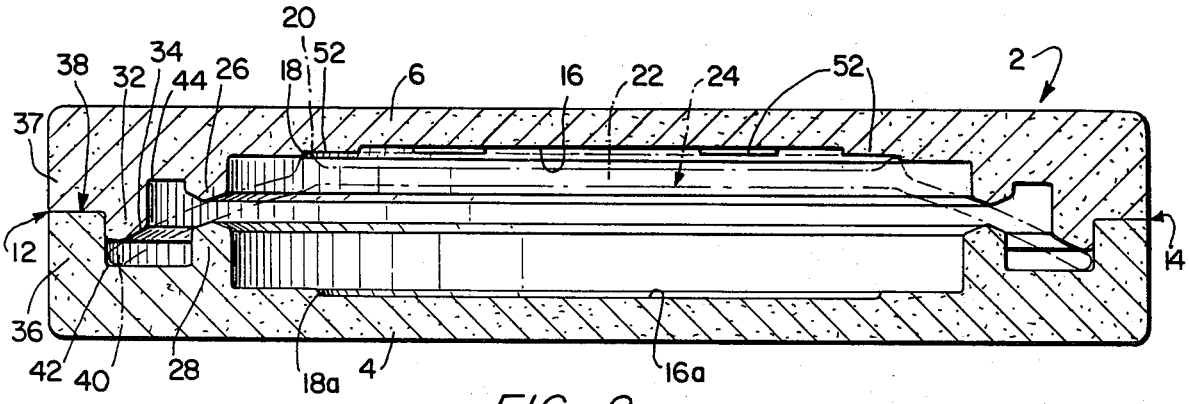
FIG. 2 is a transverse cross-section taken vertically through the closed box showing one plate of relatively large diameter in broken lines engaged within the box.

Referring now to the drawings in which like reference numerals denote similar elements, the plate packing box 2 is molded of yieldable and somewhat springy foam plastic and is comprised of a bottom 4 and top 6. Bumps 8 on the bottom peripheral flange 36 and interfit with dimples 10 on the top peripheral flange 37 to orient the bottom and top so that the flattened opposite sides 12 and 14 coincide. Either half of the box may be considered as the bottom while the other half may be considered as the top, depending upon how it is desired that the plate be displayed when the box is opened. For purposes of exposition, it will be assumed that the part 4 is the bottom and the part 6 the top. FIG. 2 illustrates the box in closed condition with a plate of relatively large diameter disposed therein with its bottom up. The flat ends 14 provide areas for sealing the box with a flat strip of clear adhesive tape (not shown).

On the inner side of box top 6 is a shallow circular pocket 16 having a short cylindrical end shoulder 18 against which the rib 20 around the bottom 22 of a relatively large plate 24 engages. On the inner sides of the box top and bottom are opposed ridges 26 and 28. The free ends of the ridges are beveled at 29, 29$^1$, 29*a* and 29*a*$^1$ so that they engage flatwise against the plate-flange. On the peripheral flange 37 of the box top, on its inner side, is a peripheral rib 32. The free end of rib 32 is beveled as at 34 to engage flatwise against the plate flange 30. The outer side of flange 37 is indented to provide a rabbet 38 into which the peripheral flange 36 of the box bottom nests. As will be apparent from FIG. 2, the plate 34 is constrained against relative axial and radial movement within the box by snug confinement by the box at a plurality of radially spaced annular areas.

Figure 3:
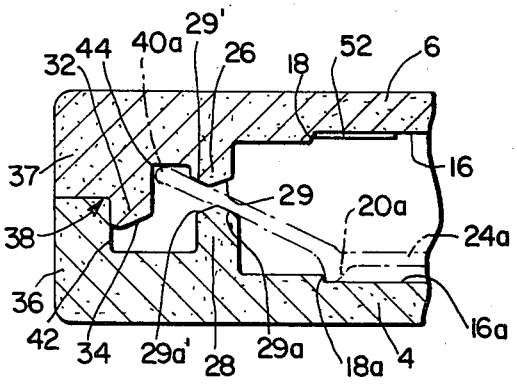
FIG. 3 is a fragmentary cross-section showing part of a plate of relatively small diameter engaged in the box.
Figure 4:
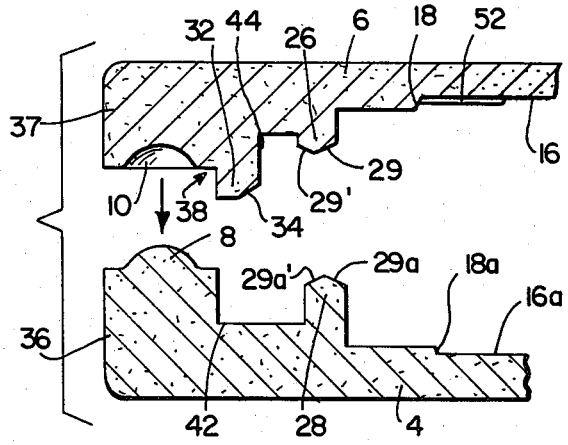
FIG. 4 is a fragmentary vertical cross-section showing the inner fitting bumps and dimples on the edges of the box bottom and top.
Figure 5:
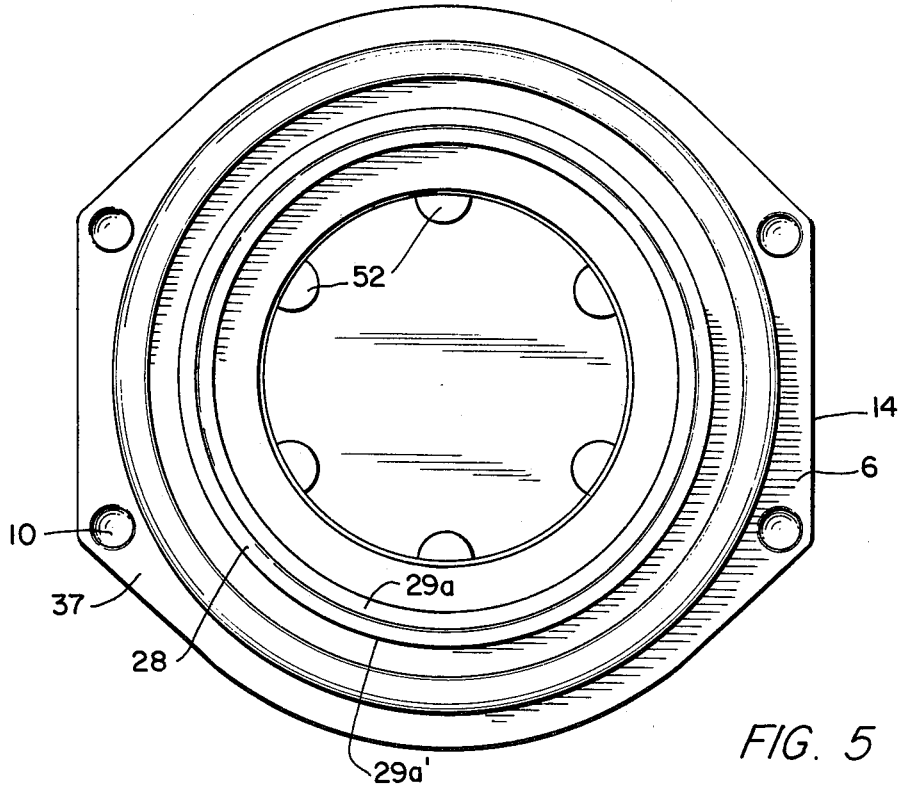
FIG. 5 is a plan view of the top.
Figure 6:
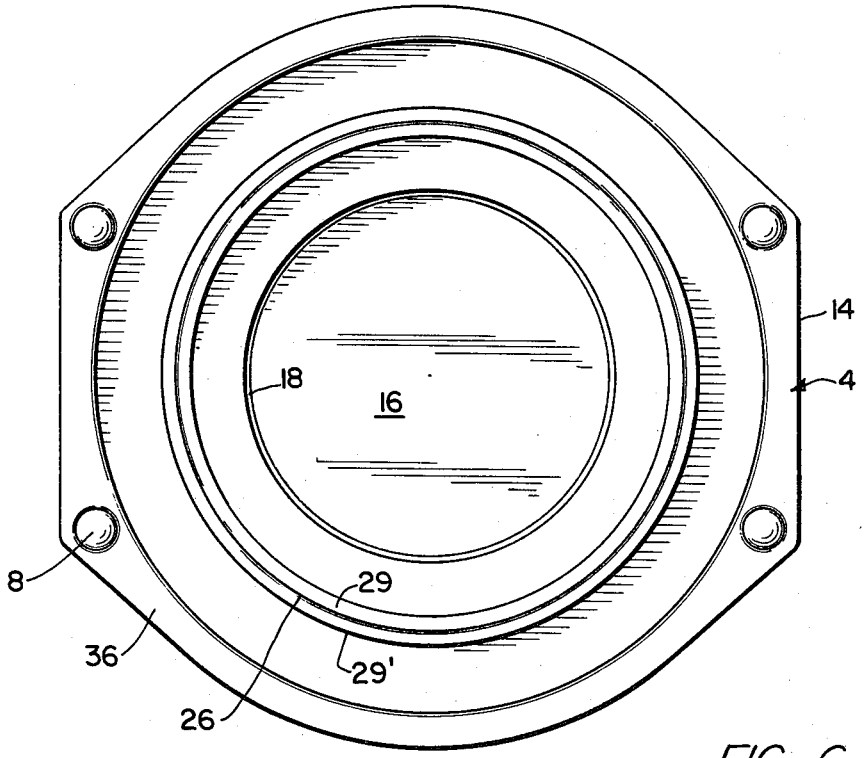
FIG. 6 is a plan view of the bottom.

FIG. 3 illustrates the areas of confinement of a smaller diameter plate which is seated with its upper side up in the box. Box bottom 4 is provided with a shallow circular pocket 16*a* of slightly less diameter and the pocket 16 in box top 6, the pocket having a cylindrical outer wall 18*a* against which the rib 20*a* of the smaller plate engages. The peripheral edge 40 or 40*a* of the plate flange 30 or 30*a* engages in the corner 42 or 44 at the base of the inner side of annular rib 36 or 37.

By comparing FIG. 2 with 3, it will be apparent that the relatively smaller plate 24A is confined and protected in virtually the same manner as the larger plate 24. If it is desired that the upper side of the larger plate be displayed when the box is opened, the box as shown in FIG. 2 is simply inverted from its position shown in FIG. 2 and the part 4 designated as the top.

Because there are some variations in plate size, provisions are made for holding smaller variants. There are small raised tabs 52 molder inwardly from shoulder 18 into 6. The tabs are strong enough in the lateral direction to present lateral sliding of a smaller plate, for example, of 8 5/16" or 8 7/16" diameter whereas the tabs, being thin, are compressible so that the rib on the bottom of a standard 8½" plate will simply compress the tabs and engage against the shoulder 18.

The box is usable for plates of material other than china and it will also protect plates smaller than those described above.

I claim:

1. A box formed of yieldable and springy foam plastic for a plate of the type having a depending annular rib around the underside and a generally frusto-conical peripheral portion extending upwardly therefrom, comprising:

relatively shallow separable bottom and top portions having hollow inner sides, said bottom and top portions each having an annular ridge means on the inner side thereof, said ridge means being spaced inwardly from the peripheral flanges thereon and being oppositely directed from one another and defining therebetween nip means for yieldably embracing the peripheral portion of a plate.

2. A foam plastic box as claimed in claim 1, said ridge means having beveled free end portions for engaging flatwise against the peripheral portion of the plate.

3. A foam plastic box as claimed in claim 1, at least one of said bottom and top portions having on the hollow inner side thereof a circular pocket surrounded by an annular shoulder for accommodating and laterally confining the annular rib on the bottom of the plate.

4. The foam plastic box as claimed in claim 3, said bottom and top portions each having on the hollow inner side thereof a circular pocket surrounded by an annular shoulder, the pocket on one of said portions being of lesser diameter than the pocket on the other of said portions whereby to accommodate and laterally confine the ribs on plates of relatively large and small diameter.

5. A foam plastic box as claimed in claim 1, at least one of said box portions, at the base of the peripheral flange thereon defining an inwardly-facing angle for accommodating and confining the peripheral edge of a plate.

6. A foam plastic box as claimed in claim 3, said portion having the circular pocket surrounded by an annular shoulder also having a plurality of angularly spaced shallow comprensible tabs extending inwardly into said pocket from said shoulder.

7. A box formed of yieldable and springy foam plastic for a plate of the type having a depending annular rib around the underside and a generally frusto-conical peripheral portion extending upwardly therefrom, comprising:

relatively shallow separable bottom and top portions having hollow inner sides, one of said portions having an outwardly facing rabbet around a peripheral flange thereof, the other said portions having a peripheral flange engaging in said rabbet, said bottom and top portions each having an annular ridge means on the inner side thereof, said ridge means being spaced inwardly from the peripheral flanges thereon and being oppositely directed from one another and defining therebetween nip means for yieldably embracing the peripheral portion of a plate.

* * * * *

UNITED STATES PATENT AND TRADEMARK OFFICE

CERTIFICATE OF CORRECTION

PATENT NO. : 4,386,702

DATED : June 7, 1983

INVENTOR(S) : Frank L. Schultz et al.

It is certified that error appears in the above-identified patent and that said Letters Patent is hereby corrected as shown below:

Column 1, line 6
Correct the spelling of --sensitive--.

Column 1, line 39
Delete "provided", insert --provide--.

Column 1, line 67
Delete "and".

Column 2, line 26
Delete "34", insert --24--.

Column 2, line 32
Delete "and", insert --than--.

Column 2, line 37
Delete "annular rib", insert --peripheral flange--.

Column 2, line 47
Correct the spelling of --molded--.

Column 2, line 48
After "into", insert --top--.

Column 2, line 49
Delete "present", insert --prevent--.

UNITED STATES PATENT AND TRADEMARK OFFICE

CERTIFICATE OF CORRECTION

PATENT NO. : 4,386,702

DATED : June 7, 1983

INVENTOR(S) : Frank L. Schultz et al.

It is certified that error appears in the above-identified patent and that said Letters Patent is hereby corrected as shown below:

Claim 6, column 4, line 6
Correct the spelling of --compressible--.

Signed and Sealed this

Sixth Day of September 1983

[SEAL]

*Attest:*

GERALD J. MOSSINGHOFF

*Attesting Officer*

*Commissioner of Patents and Trademarks*